US008840047B2

(12) United States Patent
Wu

(10) Patent No.: US 8,840,047 B2
(45) Date of Patent: Sep. 23, 2014

(54) SHOWER HEAD WITH AUTO-LOCKING COVER

(75) Inventor: Chin-Lung Wu, Taichung Hsien (TW)

(73) Assignee: Purity (Xiamen) Sanitary Ware Co., Ltd., Xiamen, Fujian (CN)

( * ) Notice: Subject to any disclaimer, the term of this patent is extended or adjusted under 35 U.S.C. 154(b) by 277 days.

(21) Appl. No.: 13/590,191

(22) Filed: Aug. 21, 2012

(65) Prior Publication Data

US 2014/0054397 A1 Feb. 27, 2014

(51) Int. Cl.

| | |
|---|---|
| ***A47K 3/022*** | (2006.01) |
| ***A47K 3/28*** | (2006.01) |
| ***B05B 1/14*** | (2006.01) |
| ***B05B 1/16*** | (2006.01) |
| ***B05B 1/30*** | (2006.01) |

(52) U.S. Cl.
USPC ..... 239/555; 239/436; 239/548

(58) Field of Classification Search
CPC ..... A47K 3/022; A47K 3/28; B05B 1/14; B05B 1/16; B05B 1/30; A62C 2/08; A62C 37/08
USPC ..... 239/436, 437, 555, 557, 558, 548; 4/605
See application file for complete search history.

(56) References Cited

U.S. PATENT DOCUMENTS

| | | | | |
|---|---|---|---|---|
| 3,252,660 | A * | 5/1966 | Hyde | 239/460 |
| 3,801,019 | A * | 4/1974 | Trenary et al. | 239/381 |
| 4,190,207 | A * | 2/1980 | Fienhold et al. | 239/381 |
| 6,354,518 | B1 * | 3/2002 | Gil et al. | 239/458 |
| 2009/0325320 | A1 * | 12/2009 | Avoyan et al. | 438/4 |

* cited by examiner

*Primary Examiner* — Justin Jonaitis

(57) ABSTRACT

A shower head with an auto-locking cover includes a body unit, a rotation support seat, a seal seat and a cover unit. The seal seat is fixedly connected to an underside of the body unit. The rotation support seat is secured through the body unit and the seal seat. The rotation support seat is formed with an insertion hole and an engaging step. The cover unit is formed with a hook corresponding to the insertion hole and the engaging step. The cover unit is mounted to an underside of the rotation support seat. The rotation support seat is further formed with an elastic piece. The cover unit is formed with an engaging recess corresponding to the elastic piece. By turning the rotation support seat, the elastic piece is engaged in the engaging recess so that the cover unit is connected to the underside of the rotation support seat.

3 Claims, 6 Drawing Sheets

SHOWER HEAD WITH AUTO-LOCKING COVER

BACKGROUND OF THE INVENTION

1. Field of the Invention

The present invention relates to a shower head, and more particularly, to a shower head with an auto-locking cover.

2. Description of the Prior Art

As shown in FIG. 1 and FIG. 2, a conventional shower head comprises a cover unit 10, a body unit 20 and a screw 30. The cover unit 10 is formed with a step for connection of the screw 30. A washer 40 is provided between the step and the screw 30. A decoration lid 50 is provided on the step. After assembly, the cover unit 10 is rotatable relative to the body unit 20 through the screw 30. This connection structure increases the finished cost, and the assembly is difficult, and the defective rate is high.

Accordingly, the inventor of the present invention has devoted himself based on his many years of practical experiences to solve these problems.

SUMMARY OF THE INVENTION

The primary object of the present invention is to provide a shower head with an auto-locking cover to simplify the connection structure and to enhance the production efficiency so as to reduce the cost.

In order to achieve the aforesaid object, the shower head with an auto-locking cover of the present invention comprises a body unit, a rotation support seat, a seal seat and a cover unit.

The seal seat is fixedly connected to an underside of the body unit. The rotation support seat is secured through the body unit and the seal seat. The rotation support seat is rotatable and mounted to the underside of the body unit. The rotation support seat is formed with an insertion hole and an engaging step. The cover unit is formed with a hook corresponding to the insertion hole and the engaging step. The cover unit is mounted to an underside of the rotation support seat. The rotation support seat is further formed with an elastic piece. The cover unit is formed with an engaging recess corresponding to the elastic piece. By turning the rotation support seat, the elastic piece is engaged in the engaging recess so that the cover unit is connected to the underside of the rotation support seat in an auto-locking way.

Preferably, the rotation support seat is formed with at least two insertion holes and at least two engaging steps. The insertion holes and the engaging steps are disposed on an inner wall of the rotation support seat. The cover unit is formed with at least two hooks corresponding to the insertion holes and the engaging steps. The hooks are disposed on an inner wall of the cover unit.

Preferably, the elastic piece is disposed on an outer edge of the rotation support seat and the engaging recess is disposed on an outer edge of the cover unit. The elastic piece is engaged in the engaging recess through rotation.

Accordingly, the rotation support seat of the present invention is secured through the seal seat welded to the underside of the body unit. The cover unit is mounted to the underside of the rotation support seat by engagement of the hooks and the engaging steps. Through the elastic pieces engaged in the engaging recesses, the cover unit is connected to the underside of the rotation support seat in an auto-locking way.

Compared to the prior art, the present invention has a simple configuration and can be assembled efficiently to reduce the cost, without using screws.

DETAILED DESCRIPTION OF THE PREFERRED EMBODIMENTS

Embodiments of the present invention will now be described, by way of example only, with reference to the accompanying drawings.

Figure 1:
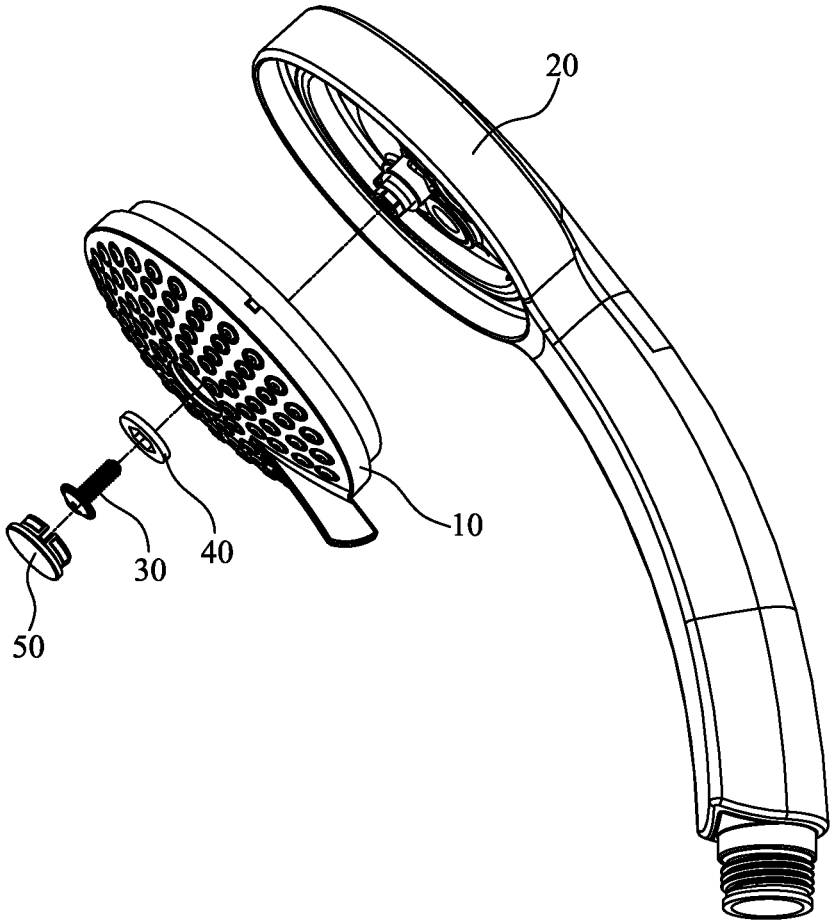
F I G. 1 Prior Art
FIG. 1 is an exploded view of a conventional shower head.
Figure 2:
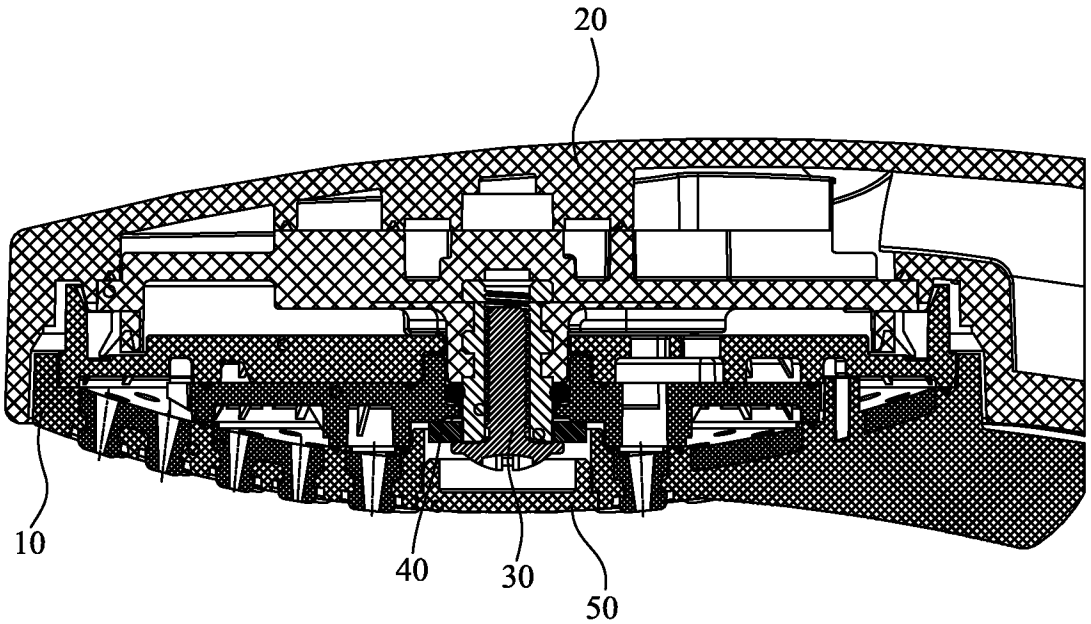
FIG. 2 Prior Art
FIG. 2 is a sectional view of the conventional shower head.
Figure 3:
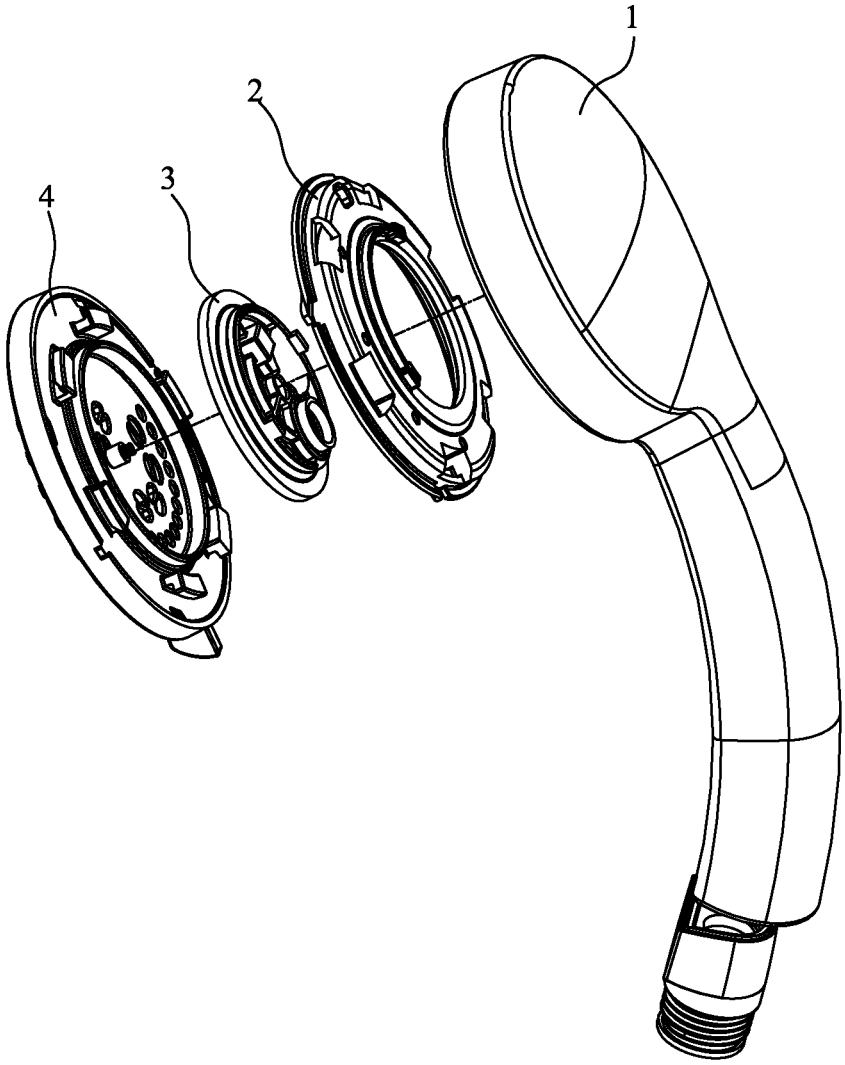
FIG. 3 is an exploded view according to a preferred embodiment of the present invention.
Figure 4:
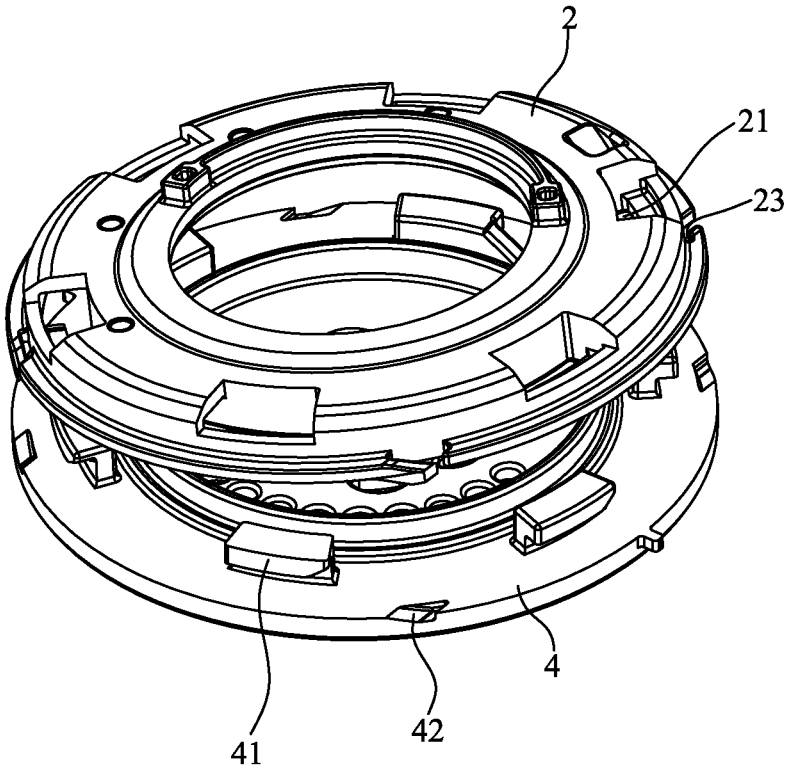
FIG. 4 is a schematic view showing the rotation support seat and the cover unit according to the preferred embodiment of the present invention.
Figure 5:
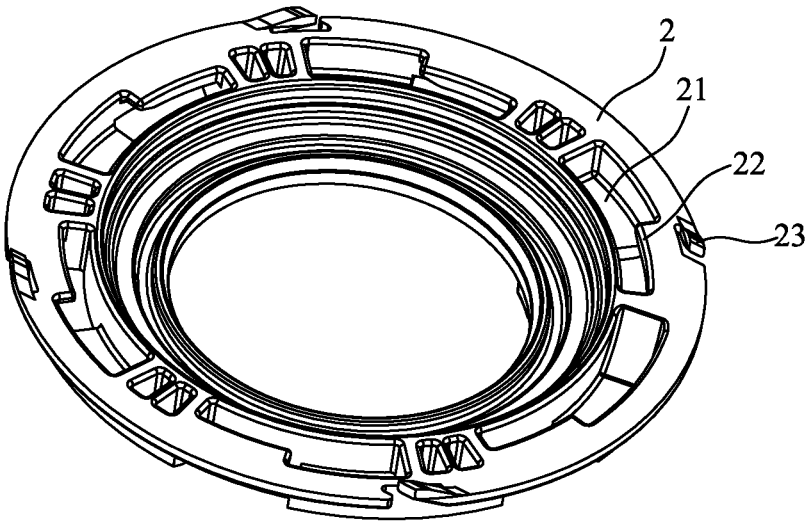
FIG. 5 is a perspective view showing the rotation support seat according to the preferred embodiment of the present invention.
Figure 6:
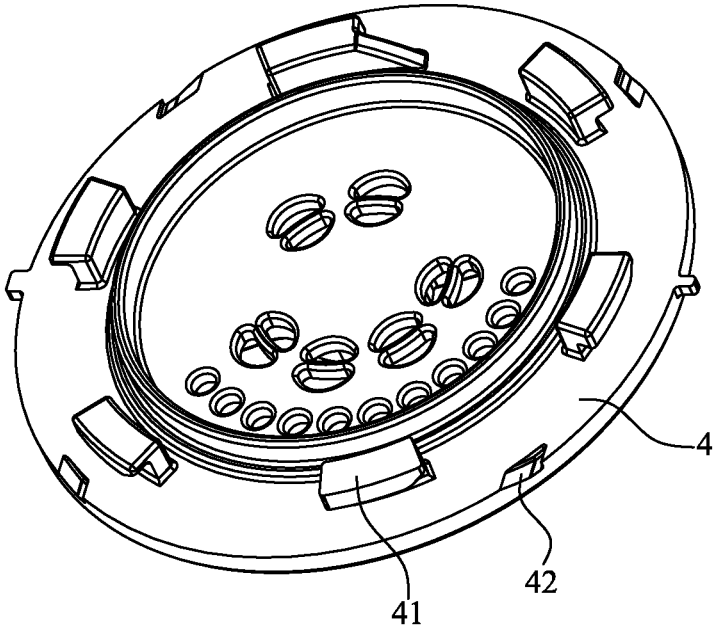
FIG. 6 is a perspective view showing the cover unit according to the preferred embodiment of the present invention.

As shown in FIG. 3 to FIG. 6, the shower head with an auto-locking cover of the present invention comprises a body unit 1, a rotation support seat 2, a seal seat 3, and a cover unit 4.

The seal seat 3 is fixedly connected to an underside of the body unit 1 by ultrasonics welding.

The rotation support seat 2 is secured through the body unit 1 and the seal seat 3, and is rotatable and mounted to the underside of the body unit 1.

The rotation support seat 2 is formed with insertion holes 21 and engaging steps 22. Preferably, the respective number of the insertion holes 21 and the engaging steps 22 is two to six. The insertion holes 21 and the engaging steps 22 are disposed on an inner wall of the rotation support seat 2. The cover unit 4 is formed with hooks 41 corresponding to the insertion holes 21 and the engaging steps 22. Preferably, the number of the hooks 41 is two to six. The hooks 41 are disposed on an inner wall of the cover unit 4.

The rotation support seat 2 is further formed with one or more elastic pieces 23. The elastic pieces 23 are disposed on an outer edge of the rotation support seat 2. The cover unit 4 is formed with one or more engaging recesses 42 corresponding to the elastic pieces 23. The engaging recesses 42 are disposed on an outer edge of the cover unit 4.

To assemble the present invention, the rotation support seat 2 is placed on the underside of the body unit 1 and the seal seat 3 is welded to the underside of the body unit 1, so that the rotation support seat 2 is mounted between the body unit 1 and the seal seat 3 and is rotatable. The hooks 41 of the cover unit 4 are inserted in the insertion holes 21 of the rotation support seat 2, and the hooks 41 are engaged with the engaging steps 22 through turning, such that the cover unit 4 is mounted to the underside of the rotation support seat 2. Meanwhile, the elastic pieces 23 are engaged in the engaging recesses 42. Because the elastic pieces 23 are not applied with a vertical force, the elastic pieces 23 won't disengage from the engaging recesses 42. Besides, the upright side walls of the engaging recesses 42 are contact with the upright side walls of the elastic pieces 23, so they cannot be further rotated, providing a limit effect. The cover unit 4 is connected to the underside of the rotation support seat 2 in an auto-locking way.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head with an auto-locking cover, comprising a body unit, a rotation support seat, a seal seat and a cover unit; the seal seat being fixedly connected to an underside of the body unit, the rotation support seat being secured through the body unit and the seal seat, the rotation support seat being rotatable and mounted to the underside of the body unit; the rotation support seat being formed with an insertion hole and an engaging step, the cover unit being formed with a hook corresponding to the insertion hole and the engaging step, the cover unit being mounted to an underside of the rotation support seat; the rotation support seat being further formed with an elastic piece, the cover unit being formed with an engaging recess corresponding to the elastic piece, by turning the rotation support seat, the elastic piece being engaged in the engaging recess so that the cover unit is connected to the underside of the rotation support seat.

2. The shower head with an auto-locking cover as claimed in claim 1, wherein the rotation support seat is formed with at least two insertion holes and at least two engaging steps, the insertion holes and the engaging steps being disposed on an inner wall of the rotation support seat, the cover unit being formed with at least two hooks corresponding to the insertion holes and the engaging steps, the hooks being disposed on an inner wall of the cover unit.

3. The shower head with an auto-locking cover as claimed in claim 1, the elastic piece is disposed on an outer edge of the rotation support seat and the engaging recess is disposed on an outer edge of the cover unit, the elastic piece being engaged in the engaging recess through rotation.

* * * * *